US005203038A

United States Patent [19]

Gibbs

[11] Patent Number: 5,203,038

[45] Date of Patent: Apr. 20, 1993

[54] WATER LEVEL SENSING APPARATUS FOR A SWIMMING POOL

[76] Inventor: Michael Gibbs, 4101 E. La Cadena, Tucson, Ariz. 85718

[21] Appl. No.: 729,230

[22] Filed: Jul. 12, 1991

[51] Int. Cl.[5] ..... E04H 4/14

[52] U.S. Cl. ..... 4/508

[58] Field of Search ..... 4/507, 508, 512, 488, 4/496; 137/426, 448, 356; 248/80, 81, 542

[56] References Cited

U.S. PATENT DOCUMENTS

| | | | |
|---|---|---|---|
| 949,327 | 2/1910 | Meskill | 248/81 |
| 2,041,549 | 5/1936 | Jaeger | 4/538 X |
| 2,809,752 | 10/1957 | Leslie | 4/508 X |
| 3,739,405 | 6/1973 | Schmidt | 4/508 |
| 3,809,116 | 5/1974 | Sanner | 4/507 X |
| 3,819,137 | 6/1974 | Smith | 248/80 X |
| 3,908,206 | 9/1975 | Grewing | 4/508 |
| 3,997,925 | 12/1976 | Hough | 4/508 |
| 4,265,598 | 5/1981 | Brand | 417/40 |
| 4,342,125 | 8/1982 | Hodge | 4/508 |
| 4,373,220 | 2/1983 | Selsted | 4/508 |
| 4,445,238 | 5/1984 | Maxhimer | 4/508 |
| 4,498,984 | 2/1985 | Colson | 210/122 |
| 4,574,405 | 3/1986 | Tams | 4/508 |
| 4,586,532 | 5/1986 | Tsolkas | 137/426 |
| 4,592,098 | 6/1986 | Magnes | 4/508 |
| 4,621,657 | 11/1986 | St. Ledger | 137/426 |
| 4,640,307 | 2/1987 | Roberts | 137/448 |
| 4,655,243 | 4/1987 | Keller | 4/508 X |
| 4,686,718 | 8/1987 | Kinkead et al. | 4/508 |
| 4,853,984 | 8/1989 | Celiano | 4/496 |
| 4,853,986 | 8/1989 | Allen | 4/508 |
| 4,904,379 | 2/1990 | Ward | 4/512 X |

*Primary Examiner*—William A. Cuchlinski, Jr.
*Assistant Examiner*—John L. Beres
*Attorney, Agent, or Firm*—Shefte, Pinckney & Sawyer

[57] ABSTRACT

A water level maintaining apparatus includes a main body element having an elongate shape and adapted to be supported by first and second support portions on the surface adjacent the edge of a swimming pool. An end portion of the main body element is supported in cantilever disposition inwardly of the edge or coping of the swimming pool above the water in the pool and a water level sensing device is mounted to the end portion. A conduit extends along the main body element and has an outlet end connected to a valve assembly and an inlet end connected to a water supply source. The water level sensing device includes a floatation element operable to float on the surface of the water and having a floatation arm connected to the valve assembly to selectively open and close the outlet end of the conduit to permit or prevent the flow of water from the conduit. The water level maintaining apparatus automatically senses variations in the level of the water in the swimming pool from a predetermined level and automatically operates the valve assembly to permit the flow of water into the swimming pool until the predetermined level is restored.

3 Claims, 2 Drawing Sheets

WATER LEVEL SENSING APPARATUS FOR A SWIMMING POOL

BACKGROUND OF THE INVENTION

The present invention relates to an apparatus for maintaining the water level of a swimming pool in a predetermined range.

The level of fluid in a reservoir such as, for example, the level of water in a swimming pool, is subject to variations due to phenomena such as evaporations. It is desirable to maintain the level of fluid in a reservoir in a predetermined range and the maintenance of the fluid level must often be a continuous ongoing process to avoid unacceptable reductions in the fluid level. For example, the water in swimming pools is continuously subjected to evaporation, which results in a lowering of the water level of the swimming pool, and damage to pool cleaning equipment such as circulation and filtration accessories can occur if the water level drops below an acceptable range.

A number of devices have been proposed for maintaining the water level of a swimming pool in a predetermined range. For example, U.S. Pat. No. 4,586,532 to Tsolkas discloses an apparatus having an arm hingedly mounted to a base member, the arm supporting a floatation body at its free end adapted to float at the top of the water in the swimming pool. The base member is secured to the edge of the swimming pool by a plurality of adjustable screws. However, the Tsolkas apparatus is not particularly well-suited for attachment to a swimming pool edge or coping having, for example, a rounded or beveled configuration. On such swimming pool edges, it may be difficult to find proper purchase of the adjustable screws of the Tsolkas apparatus, thereby precluding the base member from being securely mounted to the edge of the swimming pool. Accordingly, the need exists for a water level maintenance apparatus which is operable with swimming pools having a wide range of edge or coping configurations.

SUMMARY OF THE INVENTION

The present invention provides a water level sensing apparatus which automatically maintains the water level of a swimming pool at a predetermined level.

Briefly described, the present invention provides, in one aspect thereof, an apparatus for sensing the level of fluid in a swimming pool, including main body means having an end portion and means for supporting the main body means in free-standing disposition on a surface extending from an edge of the swimming pool with the end portion projecting in cantilever disposition over the edge of the swimming pool. The supporting means includes a first support portion for resting in free-standing disposition on the surface of the swimming pool to support the main body means thereat, and a second support portion for resting in free-standing disposition on the swimming pool surface to support the main body means thereat, the second support portion being at a spacing from the swimming pool edge greater than the spacing of the first support portion from the swimming pool edge as measured from the intersection of the swimming pool edge and a line passing through the first and second support portions. The first support portion and the second support portion each support the main body means at respective predetermined heights above the swimming pool surface, the predetermined heights at which the main body means is supported above the surface by the first and second support portions being selected such that the spacing between the end portion and the level of fluid decreases in correspondence with decreases in the spacing between the second support portion and the intersection of the line passing through the first and second support portions and the swimming pool edge and the swimming pool edge. The fluid level sensing apparatus also includes a fluid level sensing device attached to the end portion of the main body means for support thereby at a position for sensing variations in the level of fluid in the swimming pool from a predetermined fluid level.

According to a further feature of the one aspect of the present invention, the fluid level sensing apparatus also includes means for adjusting the vertical disposition of the end portion of the main body means to adjust the position of sensing by the fluid level sensing device and thereby adjust the predetermined fluid level, variations from which are sensed by the water level sensing device.

Additionally, the fluid level sensing apparatus preferably includes conduit means having a conduit for the passage of fluid therethrough and a selective closure member for selectively closing and opening one end of the conduit, the other end of the conduit being operable to receive fluid from a fluid supply source and the selective closure member being operatively connected to the fluid level sensing device for selectively opening the one end of the conduit in response to sensing by the fluid level sensing device that the variation in the level of fluid has exceeded a predetermined amount, whereby fluid introduced into the other end of the conduit by the fluid supply source is delivered by the conduit to the swimming pool.

The present invention also provides, in another aspect thereof, an apparatus for sensing the level of fluid in a swimming pool, including main body means having an end portion and means for supporting the main body means in free-standing disposition on a surface extending from an edge of the swimming pool with the end portion projecting in cantilever disposition over the edge of the swimming pool. The supporting means includes a first support portion for resting in free-standing disposition on the swimming pool surface to support the main body means thereat, and a second support portion for resting in free-standing disposition on the swimming pool surface to support the main body means thereat, the second support portion being at a spacing from the swimming pool edge greater than the spacing of the first support portion from the swimming pool edge as measured from the intersection of the swimming pool edge and a line passing through the first and second support portions. Also, the supporting means includes means for selectively adjusting the vertical spacing of the main body means and the swimming pool surface at the location at which the second support portion supports the main body means, the vertical spacing adjusting means being operable to selectively increase the vertical spacing to effect corresponding lowering of the end portion toward the fluid in the swimming pool. The fluid level sensing apparatus also includes fluid level sensing device attached to the end portion of the main body means for support thereby at a position for sensing variations in the level of fluid of the swimming pool from a predetermined fluid level.

DESCRIPTION OF THE PREFERRED EMBODIMENT

Figure 1:
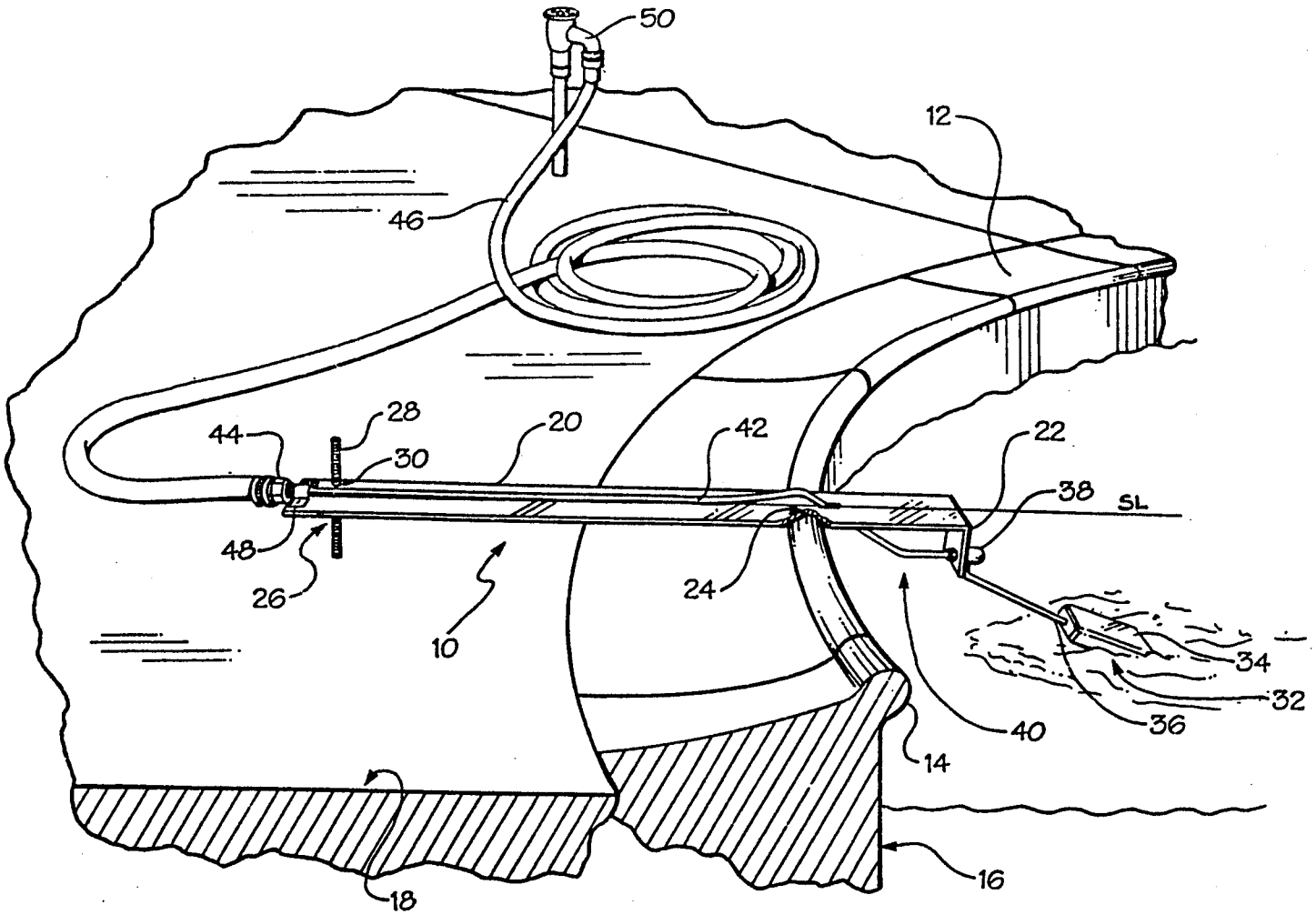
FIG. 1 is a cut-away perspective view of a portion of a swimming pool and showing the preferred embodiment of the water level maintaining apparatus of the present invention in its operating position for maintaining the water level of the swimming pool in a predetermined range.
Figure 2:
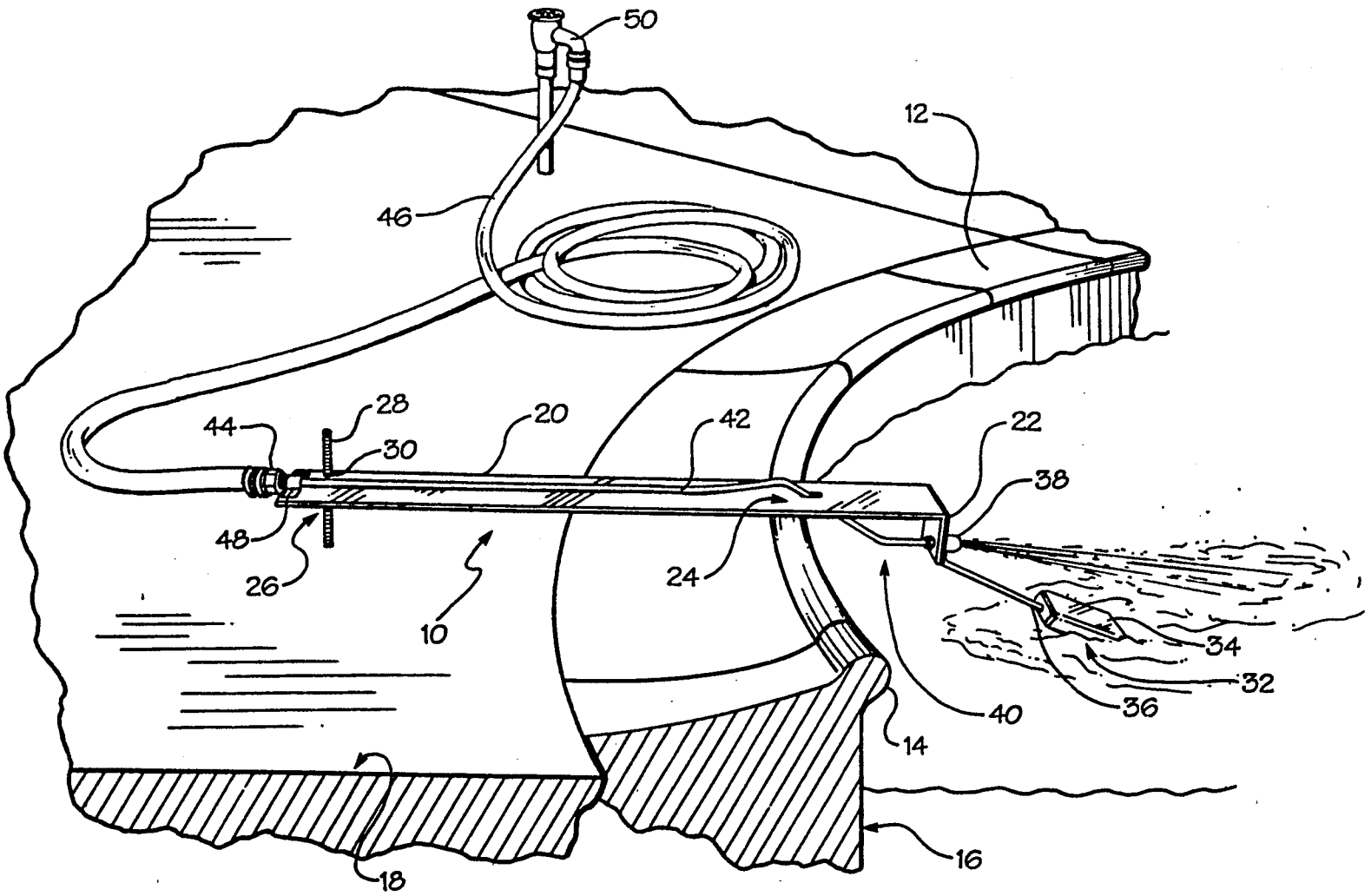
FIG. 2 is a perspective view of the swimming pool portion and the water level maintaining apparatus shown in FIG. 1 and showing the water level maintaining apparatus in its water replenishment mode.

In FIGS. 1 and 2, the preferred embodiment of the water level maintaining apparatus 10 of the present invention is illustrated. The water level maintaining apparatus 10 is operable to automatically maintain the level of water in a reservoir such as, for example, a swimming pool 12, within a predetermined range. The swimming pool 12 is of the type having a rounded edge portion in the form of a coping 14 which is formed by a plurality of premolded concrete or cement edge pieces 16. The edge pieces 16 define the periphery of the swimming pool at the top of the body of water contained in the swimming pool and the top surfaces of the edge members 16 are mounted generally flush with a pool area surface portion 18 so that the swimming pool 12 has a substantially smooth surface extending from the coping 14 along the top surfaces of the edge members 16 and the pool area surface portion 18.

The water level maintaining apparatus 10 includes a main body means preferably in the form of an elongate rigid main body element 20 having an end portion 22. The main body element 20 is preferably formed of metal and the end portion 22 is comprised of one end of the length of metal bent at approximately a right angle to the other portion of the element. The water level maintaining apparatus 10 also includes means for supporting the main body means in free-standing disposition on the surface adjacent the swimming pool 12 with the end portion 22 projecting in cantilever disposition beyond the coping 14 of the swimming pool 12. The supporting means includes a first support portion 24 for resting in free-standing disposition on the coping 14 to support the main body element 20 thereat, and a second support portion 26 for resting in free-standing disposition on the swimming pool surface. In FIG. 1, the first support portion 24 is shown in cut-away view to reveal the coping 14 thereunder.

The second support portion 26 is preferably in the form of a threaded bolt 28 threadably secured in a threaded hole 30 formed in the end of the main body element 20 opposite the end portion 22. The bolt 28 is threadably movable in the threaded hole 30 along the axis of the bolt to selectively adjust the spacing of the main body element 20 from the swimming pool surface at the location at which the second support portion 26 supports the main body element 20. The second support portion 26 is at a spacing from the swimming pool edge 14 greater than the spacing of the first support portion 24 from the swimming pool edge portion 14 as measured from the intersection of the swimming pool edge portion 14 and a line SL passing through the first and second support portions.

The water level maintaining apparatus 10 also includes a water level sensing device 32 attached to the end portion 22 of the main body element 20 for support thereby at a position for sensing variations in the level of water in the swimming pool 12 from a predetermined water level. The water level sensing device 32 includes a floatation portion 34, preferably composed of molded plastic, operable to float on the top of the water in the pool, a floatation arm 36 having one end secured to the floatation portion 34, and a valve assembly 38 fixedly mounted to the end portion 22 of the main body element 20. The other end of the floatation arm 36 is connected to the valve assembly 38. The valve assembly 38 is operable to selectively prevent and permit the delivery of water by a conduit means 40 to the swimming pool 12.

The conduit means 40 is in the form of a conduit 42, preferably in the form of rigid copper or PVC tubing, and a hose connector component 44 operable to connect the outlet end of a conventional water supply hose 46 to an inlet end of the conduit 42. The conduit 42 is supported by the main body element 20 and has an outlet end communicated with the valve assembly 38. A mounting bracket 48 secures the other end of the conduit 42 to the main body element 20.

The valve assembly 38 can be in the form of a conventional valve assembly and can include, for example, a movable stopper selectively movable into and out of sealing engagement with the outlet end of the conduit 42 to selectively prevent and permit water to exit the conduit 42. U.S. Pat. No. 4,586,532 to Tsolkas discloses a conventional valve assembly of this type in which a movable stopper is connected to the floatation arm of a floatation body for movement with the arm, the movable stopper being moved out of sealing engagement with the conduit upon movement of the arm in one direction and being moved into sealing engagement with the conduit upon movement of the floatation arm in an opposite direction.

The floatation arm 36 is pivotably mounted to the valve assembly 38 for pivoting about a horizontal axis perpendicular to the line SL. One end of the floatation arm 36 is mounted to the floatation element 34 and the other end of the floatation arm is movably mounted to the stopper of the valve assembly 38. As the floatation arm 36 rotates about the horizontal axis in a clockwise manner, the floatation arm effects movement of the stopper of the valve assembly 38 out of sealing engagement with the conduit 42 to thereby permit water to flow out of the conduit. Conversely, as the floatation arm 36 is rotated in a counterclockwise direction about the horizontal axis, the floatation arm effects movement of the stopper into sealing engagement with the conduit 42 to block the flow of water from the conduit 42.

The water hose 46 is connected to a water source such as, for example, a conventional spigot 50, for the supply of water through the hose 46 and the conduit 42 to the swimming pool 12.

In operation, the main body element 20 is positioned with its first support portion 24 resting on the edge portion 14 of the swimming pool 12 such that the end portion 22 projects in cantilever disposition beyond the edge portion 14. The hose 46 is connected to the hose connector 44 and the spigot 50 is opened to permit water to flow through the hose 46 to the conduit 42. The threaded bolt 28 is threadably adjusted relative to the main body element 20 to selectively position the floatation element 34 relative to the surface of the water in the swimming pool 12 such that the floatation element 34, as it floats on the water, maintains the floatation arm 36 in the position in which the floatation arm maintains the stopper of the valve assembly 38 in its sealed position in the conduit 42. As the threaded bolt 28 is advanced in a direction to decrease the spacing between the main body element 20 and the surface of the swimming pool 12, the first support portion 24 of the main body element 20 acts as a fulcrum about which the main body element pivots on the coping 14 and the end portion 22 is raised in correspondence with reduction in the spacing between the main body element 20 and the surface of the swimming pool 10 at the location at which the second support portion 26 supports the main body element 20. Conversely, as the threaded bolt 28 is threaded in the threaded hole 30 to increase the spacing between the main body element 20 and the swimming pool 12, the main body element 20 pivots and lowers the end portion 22 correspondingly. Since the floatation element 34 causes the floatation arm 36 to pivot from its stopper closure position to its stopper opening position as the spacing between the valve assembly 38 and the surface of the water in the swimming pool 12 increases, the water level maintaining apparatus 10 operates to automatically maintain the water level of the swimming pool 12 within a predetermined range by selectively permitting water to be delivered by the conduit 42 into the swimming pool (as shown in FIG. 2) to restore the lowered water level to the predetermined water level at which the floatation element 34 acts on the floatation arm 36 to move from its stopper opening position to its stopper closing position. The action of the floatation element 34, the floatation arm 36 and the valve assembly 38 thus operates to again block the flow of water from the conduit 42 once the water level of the swimming pool 12 has been restored to its predetermined level.

The present invention also contemplates an alternative method for positioning the main body element 20 at a selective inclination relative to the horizontal at which the floatation element 34 is buoyantly supported by the water in the swimming pool 12 so as to maintain the stopper of the valve assembly 38 in its closed position. According to this method, the main body element 20 is selectively moved along a line of movement defined by the line SL toward or away from the coping 14. As the main body element 20 is advanced along the line SL in the direction inwardly of the swimming pool 12, and if the main body element 20 is oriented at a downwardly inclination in the direction from the second support portion 26 toward the first support portion 24, the floatation element 34 will be correspondingly lowered. Conversely, if the main body element 20 is moved along the line SL in a direction outwardly of the swimming pool 12, the floatation element 34 will be correspondingly raised.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An apparatus for sensing the level of fluid in a swimming pool, comprising:

means forming a main body, the main body having an end portion, and means for supporting the main body in free-standing disposition on a surface extending from an edge of the swimming pool with the end portion projecting in cantilever disposition over the edge of the swimming pool;

the supporting means including a first support portion for resting in free-standing disposition on the surface of the swimming pool to support the main body thereat, and a second support portion for resting in free-standing disposition on the swimming pool surface to support the main body thereat, the second support portion being at a spacing from the swimming pool edge greater than the spacing of the first support portion from the swimming pool edge as measured from the intersection of the swimming pool edge and a line passing through the first and second support portions, the first support portion and the second support portion each supporting the main body at respective predetermined heights above the swimming pool surface, the predetermined heights at which the main body is supported above the surface by the first and second support portions being selected such that the spacing between the end portion and the level of fluid decreases in correspondence with decreases in the spacing between the second support portion and the intersection of the line passing through the first and second support portions and the swimming pool edge; and a swimming pool fluid surface following device including a floatation portion and means for movably securing the floatation portion to the end portion of the main body, the floatation portion extending from the end portion of the main body to a swimming pool fluid surface to be buoyantly supported thereat in an initial position relative to the end portion of the main body and the movably securing means permitting movement of the floatation portion such that, as the height of the main body above the swimming pool fluid surface changes due to increases and decreases in the level of fluid in the swimming pool, the position of the floatation portion relative to the end portion of the main body changes as the floatation portion rises and falls due to its buoyant support on the swimming pool fluid surface.

2. An apparatus according to claim 1 and further comprising means for adjusting the vertical disposition of the end portion of the main body to adjust the position of sensing by the swimming pool fluid surface following device and thereby adjust the predetermined fluid level, variations from which are sensed by the device.

3. An apparatus according to claim 2 and further comprising conduit means having a conduit for the passage of fluid therethrough and a selective closure member for selectively closing and opening one of the conduit, the other end of the conduit being operable to receive fluid from a fluid supply source and the selective closure member being operatively connected to the swimming pool fluid surface following device for selectively opening the one end of the conduit in response to sensing by the swimming pool fluid surface following device that the variation in the level of fluid has exceeded a predetermined amount, whereby fluid introduced into the other end of the conduit by the fluid supply source is delivered by the conduit to the swimming pool.

* * * * *

UNITED STATES PATENT AND TRADEMARK OFFICE

CERTIFICATE OF CORRECTION

PATENT NO. : 5,203,038

DATED : April 20, 1993

INVENTOR(S) : Michael Gibbs

It is certified that error appears in the above-identified patent and that said Letters Patent is hereby corrected as shown below:

Column 2, line 65, after "includes" insert -- a --.

Column 6, line 68, after "one" insert -- end --.

Signed and Sealed this

Fourteenth Day of December, 1993

*Attest:*

*Attesting Officer*

BRUCE LEHMAN

*Commissioner of Patents and Trademarks*